US005118074A

United States Patent [19]

Weissman

[11] Patent Number: 5,118,074

[45] Date of Patent: Jun. 2, 1992

[54] MULTIPLE POSITION FUEL PUMP LEVER HOLDING DEVICE

[76] Inventor: Steven I. Weissman, Alfred I. DuPont Bldg., Ste. 1125, 169 E. Flagler St., Miami, Fla. 33131

[21] Appl. No.: 664,343

[22] Filed: Mar. 4, 1991

[51] Int. Cl.[5] ..... B65B 3/04; G05G 5/06

[52] U.S. Cl. ..... 251/90; 74/526; 141/392; 248/215; 248/304; 251/111

[58] Field of Search ..... 74/525, 526; 141/390, 141/392; 251/90, 111; 222/74, 282, 288, 291, 529; 248/215, 304

[56] References Cited

U.S. PATENT DOCUMENTS

| | | | |
|---|---|---|---|
| 4,095,629 | 6/1978 | Jordan | 251/90 |
| 4,175,595 | 11/1979 | Noe | 251/90 |
| 4,176,695 | 12/1979 | Raske | 74/526 |
| 4,200,128 | 4/1980 | Pokrzywa | 251/90 |
| 4,201,253 | 5/1980 | Maloney | 251/90 |
| 4,278,116 | 7/1981 | Opp | 251/90 |
| 4,683,923 | 8/1987 | Harris | 74/526 |
| 4,690,182 | 9/1987 | Knaus | 74/526 |
| 4,722,375 | 2/1988 | Fox | 251/90 |

*Primary Examiner*—George L. Walton
*Attorney, Agent, or Firm*—Malloy, Downey & Malloy

[57] ABSTRACT

A device for holding a lever of a gas pump in at least two adjusted, open positions in accordance with a desired rate of flow of fuel from a nozzle thereof, the device including a hook-shaped arm structured to hang over a top surface of the gas pump handle so as to be supportably engaged thereon, and a number of parallel fingers extending outwardly from an elongate portion at spaced intervals from the hook-shaped arm, each of the fingers adapted to supportably receive the lever in one of the adjusted, open positions. The device can be carried on a key ring fitted through an aperture therein.

8 Claims, 3 Drawing Sheets

MULTIPLE POSITION FUEL PUMP LEVER HOLDING DEVICE

BACKGROUND OF THE INVENTION

1. Field of the Invention

The present invention relates to a holding device adapted to be removably fitted to a gas pump handle so as to hold a lever on the gas pump handle in one of a plurality of adjusted, open positions permitting gasoline to flow from the gas pump handle at a desired flow rate.

2. Description of the Related Art

Most conventional gas pumps found at service or filling stations include a gas pump handle fitted to the end of a hose extending from the gas pump. Almost all gas pump handles include a nozzle portion and a lever which is normally biased in a closed position so that gas will not readily flow out from the nozzle. By squeezing or pulling the lever upwardly towards the handle, a valve mechanism is opened in the handle permitting gas to flow out from the nozzle. As the lever is progressably moved against the biasing force and towards the handle, the rate of flow of gasoline increases. Usually, all gas pump handles include an automatic shutoff device interconnected with the valve mechanism which is structured to shut the valve in response to back pressure at the nozzle. The automatic shutoff device is intended to prevent accidental spills or overflow when filling a gas tank. The sensitivity of the shutoff devices in the pump handle often varies from one filling station to the next and between various pump manufacturers. Accordingly, the gasoline flow rate is often higher at some filling stations than others allowing the lever to be held in a fully open position, thereby enabling one to fill their tank at a faster rate.

Additionally, many gas pump handles are provided with a mechanism which permits the lever to be locked in one of several open positions. This allows the person filling the tank to attend to other duties such as checking the oil and cleaning the windows while the vehicle tank is being filled with gas. It is also desirous to lock the lever in an open position so that the person pumping gas does not have to constantly hold the handle and maintain pressure on the lever. In addition to the obvious inconvenience, recent studies indicate that exposure to gasoline and gasoline fumes may cause cancer. Unfortunately, in many geographic areas, most .lever locking mechanisms have been removed from gas pump handles by the filling station owner, and many new gas pump handles are not even provided with any locking mechanisms. In response, there have been numerous devices developed in the related art which are adapted to hold the lever in an open position so that a person pumping gas does not have to hold the handle and continually apply manual pressure to the lever.

Included in the related art are the U.S. patents to Ehrenhalt, U.S. Pat. No. 4,712,766; Fritz, U.S. Pat. No. 4,874,151; and Giha, U.S. Pat. No. 4,811,765. The devices disclosed in these patents are all directed to a holding device which includes a strap adapted to be wrapped around the gas pump handle and lever so as to hold the lever in an open position. A hook and loop-type fastener is fitted to the straps in each of these devices so as to enable the strap to be secured in a wrapped position around the handle and lever. While all of these devices, as disclosed in the above-referenced patents, may be adapted to achieve their intended purpose, it has been found that it is often difficult to manipulate a strap so as to effectively wrap the strap about the handle and lever, usually requiring two hands to do so. Additionally, the downward pressure exerted by the lever often causes the straps to unwrap or loosen from their secured position.

Also included in the related art are the patents to Griffin, et al., U.S. Pat. No. 4,408,791 and Fredin, et al., U.S. Pat. No. 4,200,943. The devices disclosed in each of these patents include an ice scraper for scraping ice from the windshield of an automobile and further including a lever holding mechanism for maintaining the gas pump lever in an open position. Accordingly, these devices would not be practical for use in warm, ice-free, climates. The device disclosed in the patent to Griffin, et al. includes a pair of spaced apart claw portions on one end of the ice scraper adapted to engage the lever and hold it in a fully open position against the pump handle. Thus, the Griffin, et al. device is only effective in holding the lever in one, predetermined open position. Shutoff devices built into pump handles will often not allow the pump to function with the lever in the fully open position. Addition, the Griffin, et al. device is quite cumbersome and may interfere with the structure surrounding the filling pipe on many automobiles, such as the filling pipe door or license plate, and is not designed to facilitate carrying in a pocket or purse.

The U.S. patent to Fredin, et al. discloses an ice scraper having a jam element with step surfaces adapted to be fitted between the lever and the gas pump handle so as to hold the lever in various operating positions. While the device in Fredin, et al. may be effective for its intended purpose, it is quite cumbersome and often interferes with structure surrounding the filling pipe on many automobiles, requiring use of additional fittings to prevent interference, as with a license plate. Also, the Fredin, et al. device is not designed to facilitate carrying a pocket or purse.

With the foregoing in mind, it is an object of the present invention to provide a multiple position fuel pump lever holding device which is relatively compact in size so that it cannot interfere with any structure surrounding any filling pipe and is also adapted to be carried on a key ring, in a person's pocket or in a purse so as to be readily available when needed.

It is a further object of the present invention to provide a fuel pump lever holding device which is adapted to be easily and removably hung over a gas pump handle so as to hold a lever on the handle in one of a plurality of selected, adjusted open positions.

It is still a further object of the present invention to provide a fuel pump lever holding device which is adapted for use with virtually all gas pump handles wherein the rate of gas flow can be adjusted in accordance with a particular back pressure sensitivity of a valve mechanism in the gas pump handle.

It is yet another object of the present invention to provide a fuel pump lever holding device which is relatively simple and inexpensive to manufacture, thereby significantly reducing the cost to the consuming public and making the device more marketable.

These and other objects and advantages of the present invention will be more readily apparent in the description which follows.

SUMMARY OF THE INVENTION

The present invention relates to a device adapted to hold the lever on a fuel pump handle in one of a plurality of selected, open, adjusted positions wherein gasoline may be dispensed, from a nozzle of the gas pump handle at an adjusted rate of flow without the need of manually holding the gas pump handle and lever.

The device comprises an integrally formed, one-piece member including a top portion and a bottom portion. The top portion generally consists of a hook-shaped arm having a specific and unique curvature adapted to be fitted and hang supported over the top surface of the handle of a fuel pump. The lower portion includes an elongate element extending downwardly from the hook-shaped arm and a plurality of parallel fingers extending outwardly from the elongate element in substantially perpendicular relation thereto. The parallel fingers are arranged in spaced intervals from the hook-shaped arm so as to define adjusted positions at which the lever can be supported. The specific and unique curvature of the arm, combined with the angled orientation of the elongate element and each of the parallel fingers, allows the device to hang over virtually every brand of commercially used gas pump handle (whether rounded, squared or any other shape), without slipping while maintaining the proper position to function as intended.

With the hook-shaped arm fitted to hang over the top of the pump handle, the lever is removably supported on one of the plurality of parallel extending fingers in accordance with a desired rate of gas flow. A biasing force exerted by the lever downwardly on the supporting finger serves to lock and maintain the device in a fixed position on the fuel pump handle.

A key ring may be fitted through an aperture in the device allowing the lever holding device to be carried on the key ring along with one's car keys.

The invention accordingly comprises the features of construction, a combination of elements, and arrangement of parts which will be exemplified in the description hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings, in which.

Like reference numerals refer to like parts throughout the several views of the drawings.

DETAILED DESCRIPTION OF THE PREFERRED EMBODIMENT

Figure 1:
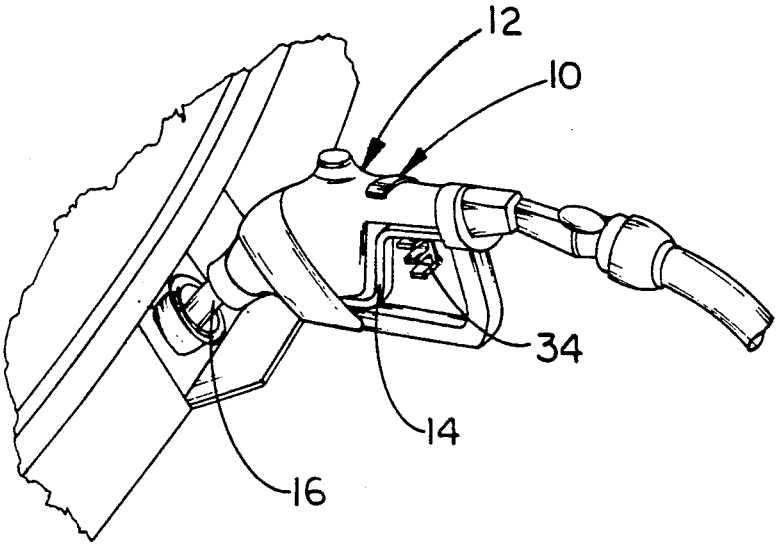
FIG. 1 is a perspective view showing the device of the present invention fitted to a fuel pump handle.
Figure 2:
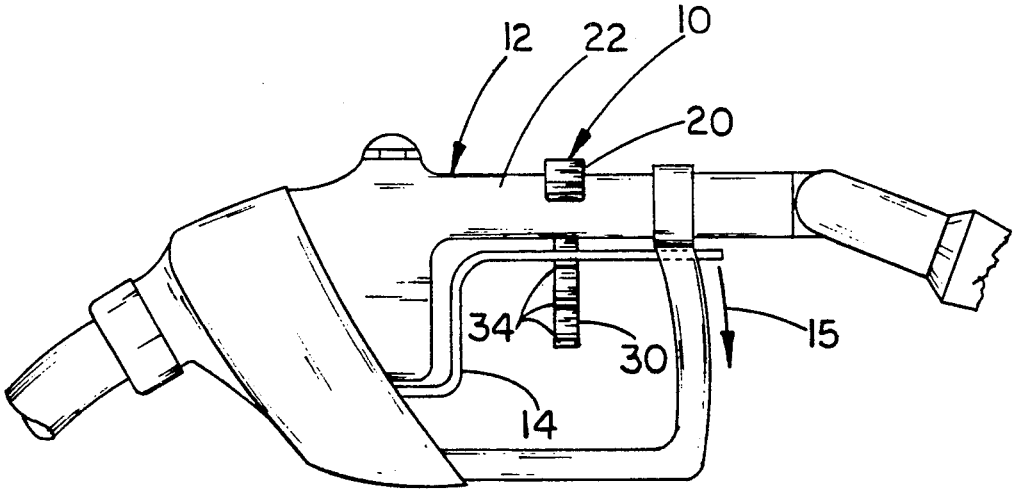
FIG. 2 is a side plan view of the device of the present invention fitted to a fuel pump handle.

Referring to FIGS. 1 and 2, the present invention relates generally to a fuel pump lever holding device 10 adapted to be removably fitted to a fuel pump handle 12 so as to hold a lever 14 of the fuel pump handle 12 in one of a plurality of adjusted, open positions thereby allowing fuel to flow from a nozzle 16 of the pump 12 at a desired rate of flow without the need of manually holding the lever 14.

The fuel pump lever holding device 10 includes an upper portion 20 specifically shaped and configured to be supportably hung over a top surface of a fuel conveying handle portion 22 of the fuel pump handle 12. An elongate element 30 extends downwardly from the top portion 20 of the device 10 and includes a plurality of parallel fingers 34 extending outwardly in substantially perpendicular relation thereto. As seen in FIGS. 1 and 2, with the upper portion 20 supported on the fuel conveying handle portion 22, the lever 14 is supported on one of the parallel fingers 34, wherein a downward biasing force of the lever 14 (as indicated by the arrow 15) serves to maintain the device 10 in a fixed, attached position on the fuel pump handle 12.

Figure 3:
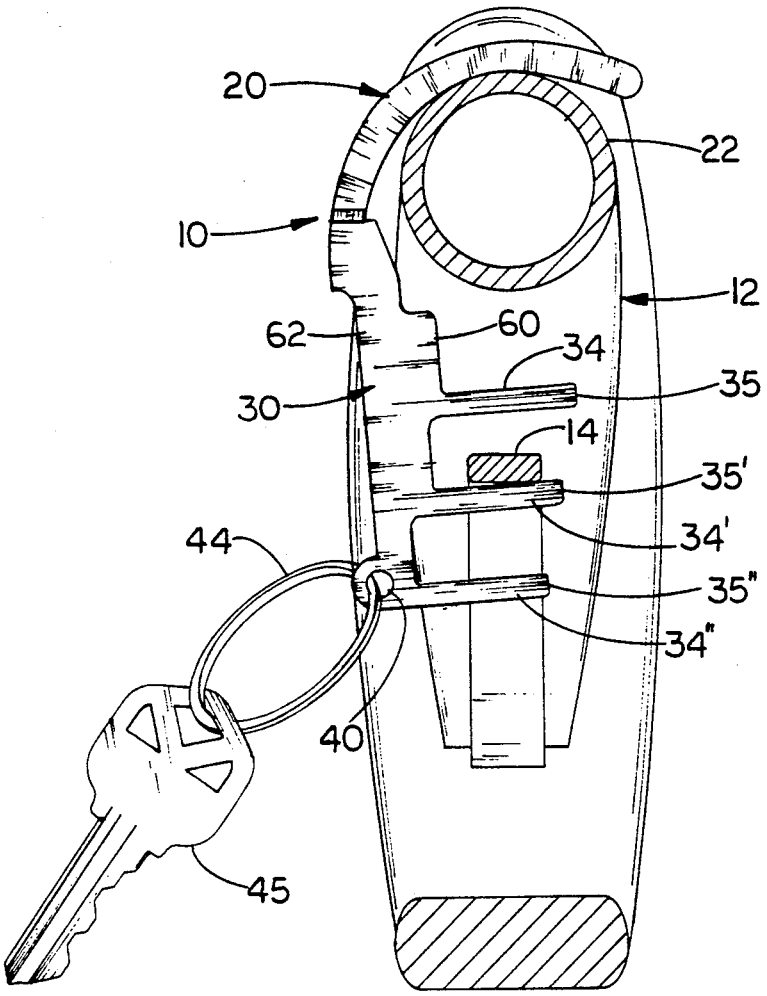
FIG. 3 is a plan view, in partial section, illustrating the attachment of the device of the present invention to a fuel pump handle.

Referring to FIG. 3, the attachment of the device 10 to the fuel pump handle 12 is more accurately depicted wherein the upper portion 20 comprises a partially curved or hook-shaped arm which is specifically shaped and configured so as to substantially engage a top surface of the fuel conveying handle portion 22. The elongate element 30 extends downwardly from the upper portion 20 and when attached to the fuel pump handle 12, the elongate element 30 is angled slightly inward towards the lever 14 relative to the fuel pump handle 12 so as to avoid interference with any surrounding structure of the vehicle or fuel pump. Additionally, the inwardly angled orientation of the elongate portion 30 eliminates any slippage of the lever 14 from a supported position on one of the parallel fingers 34. In this manner, the device 10 is effectively maintained in a fixed, attached position on the fuel pump handle 12. An aperture 40 extending through a lower portion of the elongate element 30 is specifically sized and configured to allow receipt of a key ring 44 therethrough so that the device 10 can be carried on the key ring 44 along with the user's automobile keys 45.

Figure 4:
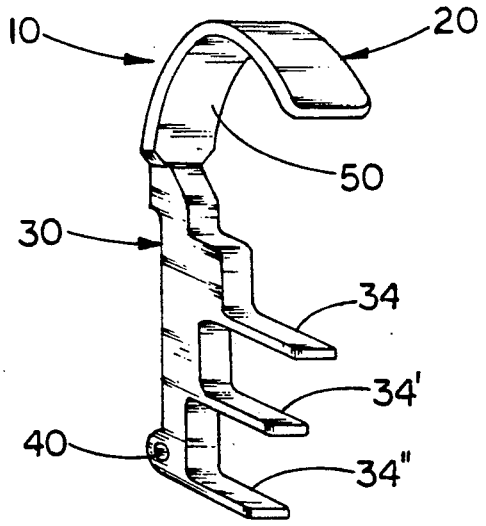
FIG. 4 is a perspective view of a preferred embodiment of the present invention.

The hook-shaped arm of the upper portion 20 preferably includes a flat underside surface 50, as illustrated in FIG. 4, adapted to sufficiently engage the top surface of the fuel conveying handle portion 22. Additionally, the upper portion 20 includes a substantially greater width than the remainder of the device 10, providing for increased stability and support over the top surface of the fuel conveying handle portion 22.

Figure 5:
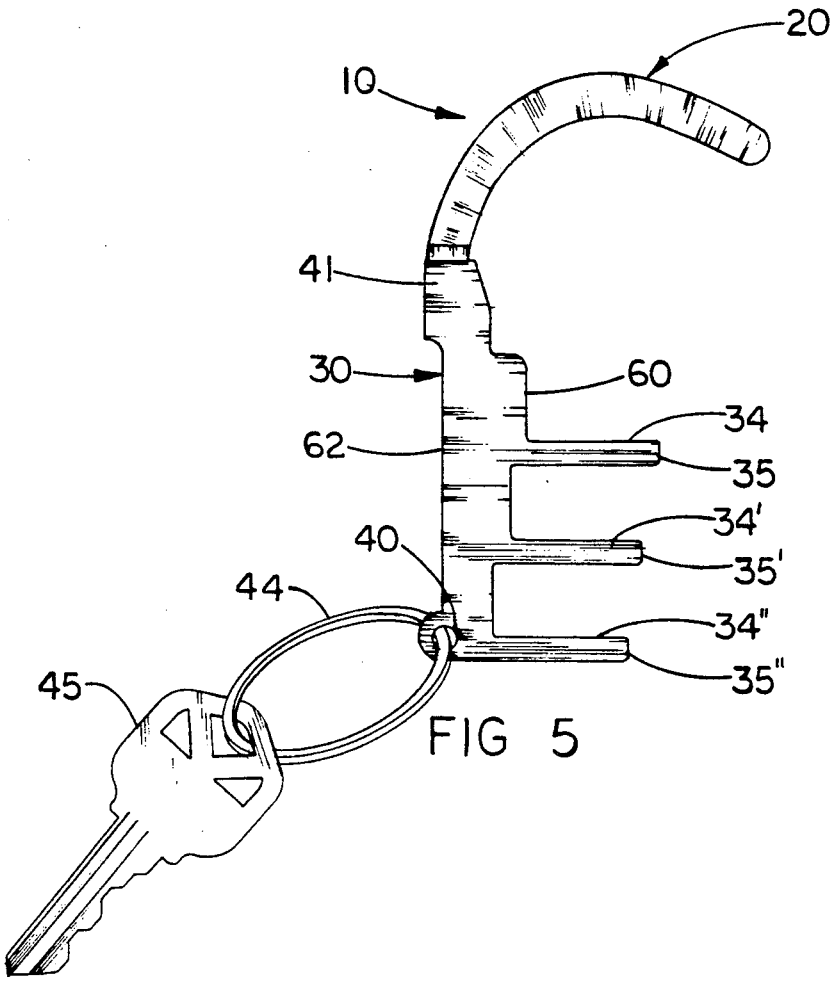
FIG. 5 is a side plan view of a preferred embodiment of the present invention showing a key ring attached thereto.

As best illustrated in FIG. 5, the elongate element 30 includes a front face 60 and a rear face 62 with the width therebetween progressively decreasing in a stepped manner between each of the plurality of parallel fingers 34, 34', and 34''. The parallel fingers 34 extend outwardly from the front face 60 in substantially perpendicular relation thereto and are each of equal length. Due to the stepped configuration of the elongate element 30, decreasing in width from top to bottom, the distal ends 35, 35', and 35'' of the corresponding fingers 34, 34', and 34'' terminate in a stepped orientation with the device 10 positioned in a substantially upright manner as seen in FIG. 5. However, in use, as seen in FIG. 3, with the elongate element angled inwardly, the distal ends 35, 35' and 35'' are arranged in a substantially vertical orientation so that the lever 14 can fully engage each of the fingers 34, 34', and 34'', while the front face 60 stabilizes the elongate element 30 in the proper, operable position against the lever 14.

Figure 6:
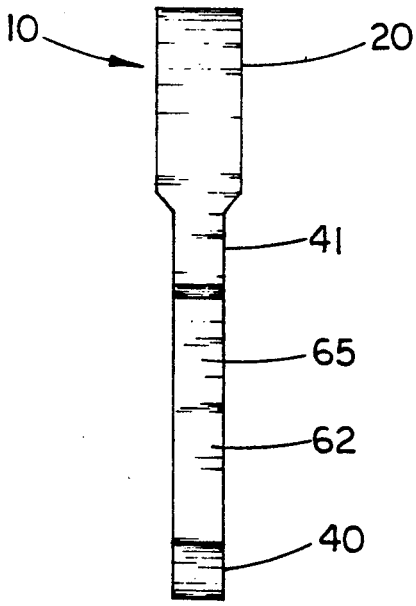
FIG. 6 is a rear plan view of a preferred embodiment of the device of the present invention.

Referring to FIG. 6, the increased width of the top portion relative to the remainder of the device 10 is illustrated. Additionally, FIG. 6 shows the rear face 62 of the elongate element 30 which includes a substantially flat portion 65 indented between the key ring aperture 40 and a top end 41 of the elongate element 30. The flat portion 65 on the rear face 62 or the opposite side faces of the elongate element 30 are ideally suited for placement of advertising or other indicia thereon.

Now that the invention has been described, what is claimed is:

1. For use on a gas pump of the type having a fluid conveying handle, a nozzle, and a lever, wherein movement of the lever from a normally biased closed position serves to activate fluid flow through the handle and out of the nozzle, a lever holding device comprising:

an integrally formed, one-piece member having an upper portion and a lower portion, said upper portion including a substantially hook-shaped arm structured and disposed to hang over and engage a top surface of the fluid conveying handle, said lower portion including an elongate element extending downwardly from said upper portion, a plurality of parallel fingers extending outwardly from said elongate element in substantially perpendicular relation thereto, said plurality of fingers disposed successively in spaced intervals relative to hook-shaped arm and each of said fingers being structured to supportably receive the lever on an upper exposed surface thereof, in one of a plurality of adjusted, open positions so as to achieve an adjusted rate of fluid flow out of the nozzle, said elongate element, and said parallel fingers defining a step construction, said elongate element progressively decreasing in width, measured between a front face and a rear face thereof, downwardly between each of said plurality of fingers which terminate in a step progression, and said elongate element being angled slightly inward towards the gas pump lever when the device is fitted to the handle and lever of the gas pump in such a manner that a biasing force exerted downwardly by the lever on one of said parallel fingers serves to maintain the device in a fixed, supported position on the fluid conveying handle to achieve one of said adjusted positions.

2. A device as in claim 1 wherein said hook-shaped arm includes a substantially flat undersurface adapted to supportably engage said top surface of the fluid conveying handle.

3. A device of claim 2 wherein said hook-shaped arm comprises a substantial width to provide increased support and stability against said top surface of the fluid conveying handle.

4. A device as in claim 3 wherein said elongate element includes said front face, said rear face, and two opposite side faces.

5. A device as in claim 4 wherein a lower end of said elongate element includes an aperture extending therethrough between said opposite side faces, said aperture being structured and disposed to receive a key ring therethrough.

6. A device as in claim 5 further including a key ring supportably received through said aperture.

7. A device as in claim 6 wherein each of said parallel fingers are of equal length.

8. A device as in claim 7 wherein said plurality of parallel fingers are progressively spaced, increasing in distance from said hook-shaped arm from a first finger to a last finger.

* * * * *